US011600942B2

(12) United States Patent
Nakano et al.

(10) Patent No.: US 11,600,942 B2
(45) Date of Patent: Mar. 7, 2023

(54) CONNECTOR AND FITTING CONNECTOR

(71) Applicant: Yazaki Corporation, Tokyo (JP)

(72) Inventors: Katsuya Nakano, Shizuoka (JP); Takashi Sone, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 35 days.

(21) Appl. No.: 17/365,377

(22) Filed: Jul. 1, 2021

(65) Prior Publication Data

US 2022/0013950 A1 Jan. 13, 2022

(30) Foreign Application Priority Data

Jul. 7, 2020 (JP) ..... JP2020-116744

(51) Int. Cl.

| | |
|---|---|
| ***H01R 13/52*** | (2006.01) |
| ***H01R 12/70*** | (2011.01) |
| ***H01R 13/512*** | (2006.01) |
| ***H01R 103/00*** | (2006.01) |

(52) U.S. Cl.

CPC ..... *H01R 13/521* (2013.01); *H01R 12/7005* (2013.01); *H01R 13/512* (2013.01); *H01R 2103/00* (2013.01)

(58) Field of Classification Search

CPC ..... H01R 13/5219; H01R 13/521; H01R 13/512; H01R 12/7005; H01R 2103/00

USPC ..... 439/271–273

See application file for complete search history.

(56) References Cited

U.S. PATENT DOCUMENTS

| | | | | |
|---|---|---|---|---|
| 10,897,103 | B1 * | 1/2021 | Sundarakrishnamachari | H01R 13/5202 |
| 2019/0363486 | A1 * | 11/2019 | Ochiai | H01R 13/627 |
| 2020/0091659 | A1 * | 3/2020 | Tada | H01R 13/6461 |

FOREIGN PATENT DOCUMENTS

| | | | |
|---|---|---|---|
| JP | 2002-190346 | A | 7/2002 |
| JP | 2009-295321 | A | 12/2009 |
| JP | 2011-108749 | A | 6/2011 |
| JP | 2013-110009 | A | 6/2013 |
| JP | 2015-5432 | A | 1/2015 |

* cited by examiner

*Primary Examiner* — Gary F Paumen

(74) *Attorney, Agent, or Firm* — Sughrue Mion, PLLC

(57) ABSTRACT

A connector according to the present invention includes a terminal fitting, a housing component which houses the terminal fitting, and an annular water cut-off member which is assembled to an outer peripheral surface of the fitting portion of the housing component and brings an outer peripheral side of the water cut-off member into close contact with an inner peripheral surface of a mating fitting portion at a fitting completion position.

5 Claims, 11 Drawing Sheets

CONNECTOR AND FITTING CONNECTOR

CROSS-REFERENCE TO RELATED APPLICATION(S)

The present application claims priority to and incorporates by reference the entire contents of Japanese Patent Application No. 2020-116744 filed in Japan on Jul. 7, 2020.

BACKGROUND OF THE INVENTION

1. Field of the Invention

The invention relates to a connector and a fitting connector.

2. Description of the Related Art

A connector has been known to fit and connect a fitting portion of a housing to a fitting portion of a mating connector or a terminal block to electrically connect the terminal fittings of each of the fitting portions. Since a cylindrical gap is formed between the fitting portions, this type of connector has an annular water cut-off member such as a packing arranged in the gap in order to seal the gap. For example, the following Japanese Patent Application Laid-open No. 2002-190346 and Japanese Patent Application Laid-open No. 2011-108479 disclose a connector in which a squarely cylindrical gap is filled with a squarely annular water cut-off member.

When the water cut-off member is formed in an annular shape such as a square shape in which a plurality of side portions and a plurality of corner portions are alternately connected, the corner portions are less likely to be elastically deformed than the side portions depending on the shape of the corner portions, and the adhesion of each fitting portion to the inner peripheral surface and the outer peripheral surface may possibly be lowered in the corner portions than in the side portions. Therefore, in the case where such an annular water cut-off member is used in the connector, in order to improve the sealing performance, it may be necessary to take measures different from the case where an annular ring-shaped water cut-off member is used.

SUMMARY OF THE INVENTION

Accordingly, it is an object of the present invention to provide a connector and a fitting connector capable of improving the sealing performance even when a water cut-off member having a corner portion is used.

To achieve the above objection, a connector according to one aspect of the present invention includes a terminal fitting; a housing component which houses the terminal fitting and is provided with a fitting portion for fitting and connecting an outer peripheral surface of the fitting portion to an inner peripheral surface of a mating fitting portion; and an annular water cut-off member which is assembled to the outer peripheral surface of the fitting portion with an inner peripheral side of the water cut-off member brought into close contact with the outer peripheral surface, and brings an outer peripheral side of the water cut-off member into close contact with the inner peripheral surface of the mating fitting portion at a fitting completion position of the fitting portion and the mating fitting portion, wherein the fitting portion has the outer peripheral surface in which a plurality of outer peripheral side portions for each inner peripheral side portion arranged with a first gap to face the inner peripheral side portion of the inner peripheral surface of the mating fitting portion at the fitting completion position, and a plurality of outer peripheral corner portions for each inner peripheral corner portion arranged with a second gap to face the inner peripheral corner portion of the inner peripheral surface of the mating fitting portion at the fitting completion position, are alternately connected in a circumferential direction, the water cut-off member has a water cut-off side portion for each combination of a pair of the outer peripheral side portions and the inner peripheral side portions that brings the inner peripheral side and the outer peripheral side into close contact between the pair of the outer peripheral side portions and the inner peripheral side portions, and a water cut-off corner portion for each combination of a pair of the outer peripheral corner portions and the inner peripheral corner portions that brings the inner peripheral side and the outer peripheral side into close contact between the pair of the outer peripheral corner portions and the inner peripheral corner portions, and the outer peripheral corner portion is formed so that a spacing of the second gap is narrower than a spacing of the first gap.

According to another aspect of the present invention, in the connector, it is preferable that a plurality of the first gaps is formed such that all of the first gaps are arcuate or linear, or is formed such that arcuate and linear shapes are mixed, and a plurality of the second gaps is formed such that all of the second gaps are arcuate.

According to still another aspect of the present invention, in the connector, it is preferable that the outer peripheral surface of the fitting portion comprises the four outer peripheral side portions and the four outer peripheral corner portions.

According to still another aspect of the present invention, the connector may further includes a screw member for screwing and fixing a fixing portion of the housing component to a mating fixing portion at the fitting completion position.

To achieve the above objection, a fitting connector according to still another aspect of the present invention includes a first connector and a second connector electrically connected at a fitting completion position fitted to each other; and an annular water cut-off member provided on either one of the first connector and the second connector between the first connector and the second connector, wherein the first connector comprises a terminal fitting and a housing component which houses the terminal fitting and is provided with a fitting portion, the second connector includes a mating terminal fitting physically and electrically connected to the terminal fitting, and a mating housing component which houses the mating terminal fitting and is provided with a mating fitting portion for fitting and connecting an outer peripheral surface of the fitting portion to an inner peripheral surface of the mating fitting portion, the fitting portion has the outer peripheral surface in which a plurality of outer peripheral side portions and a plurality of outer peripheral corner portions are alternately connected in a circumferential direction, the mating fitting portion has the inner peripheral surface in which a plurality of inner peripheral side portions for each of the outer peripheral side portion arranged with a first gap to face the outer peripheral side portion at the fitting completion position of the mating fitting portion and the fitting portion, and a plurality of inner peripheral corner portions for each of the outer peripheral corner portion arranged with a second gap to face the outer peripheral corner portion at the fitting completion position, are alternately connected in a circumferential direction, the water cut-off member has a water cut-off side portion for each combination of a pair of the outer peripheral side portions and the inner peripheral side portions that brings an inner peripheral side and an outer peripheral side of the water cut-off member into close contact between the pair of the outer peripheral side portions and the inner peripheral side portions, and a water cut-off corner portion for each combination of a pair of the outer peripheral corner portions and the inner peripheral corner portions that brings the inner peripheral side and the outer peripheral side into close contact between the pair of the outer peripheral corner portions and the inner peripheral corner portions, and the water cut-off member is assembled to the outer peripheral surface of the fitting portion or the inner peripheral surface of the mating fitting portion, and at least one of the outer peripheral corner portion and the inner peripheral corner portion is formed so that a spacing of the second gap is narrower than a spacing of the first gap.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
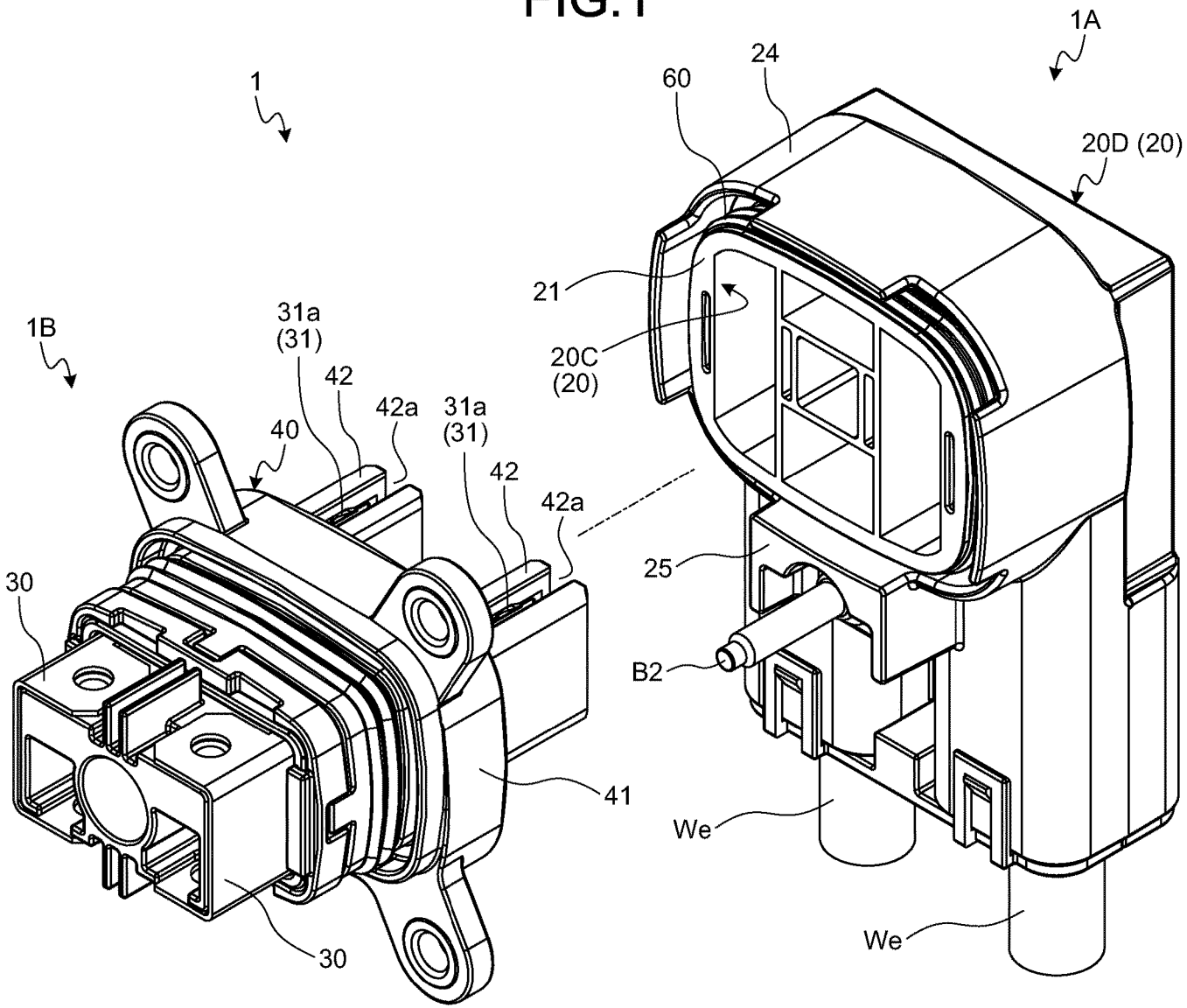
FIG. 1 is a perspective view illustrating a state before fitting and connecting a fitting connector of an embodiment.

Embodiments of the connector and the fitting connector according to the present invention will be described below in detail with reference to the drawings. Note that the present invention is not limited by the embodiments.

Embodiment

One embodiment of the connector and the fitting connector according to the present invention will be described with reference to FIGS. 1 to 12.

Reference numeral 1 in FIGS. 1 to 4 denotes the fitting connector of the present embodiment. The fitting connector 1 includes a first connector 1A and a second connector 1B electrically connected at a fitting completion position fitted to each other. Further, the fitting connector 1 includes an annular water cut-off member 60 provided on either one of the first connector 1A and the second connector 1B between the first connector 1A and the second connector 1B as described below (FIGS. 1 and 4 to 7).

Figure 4:
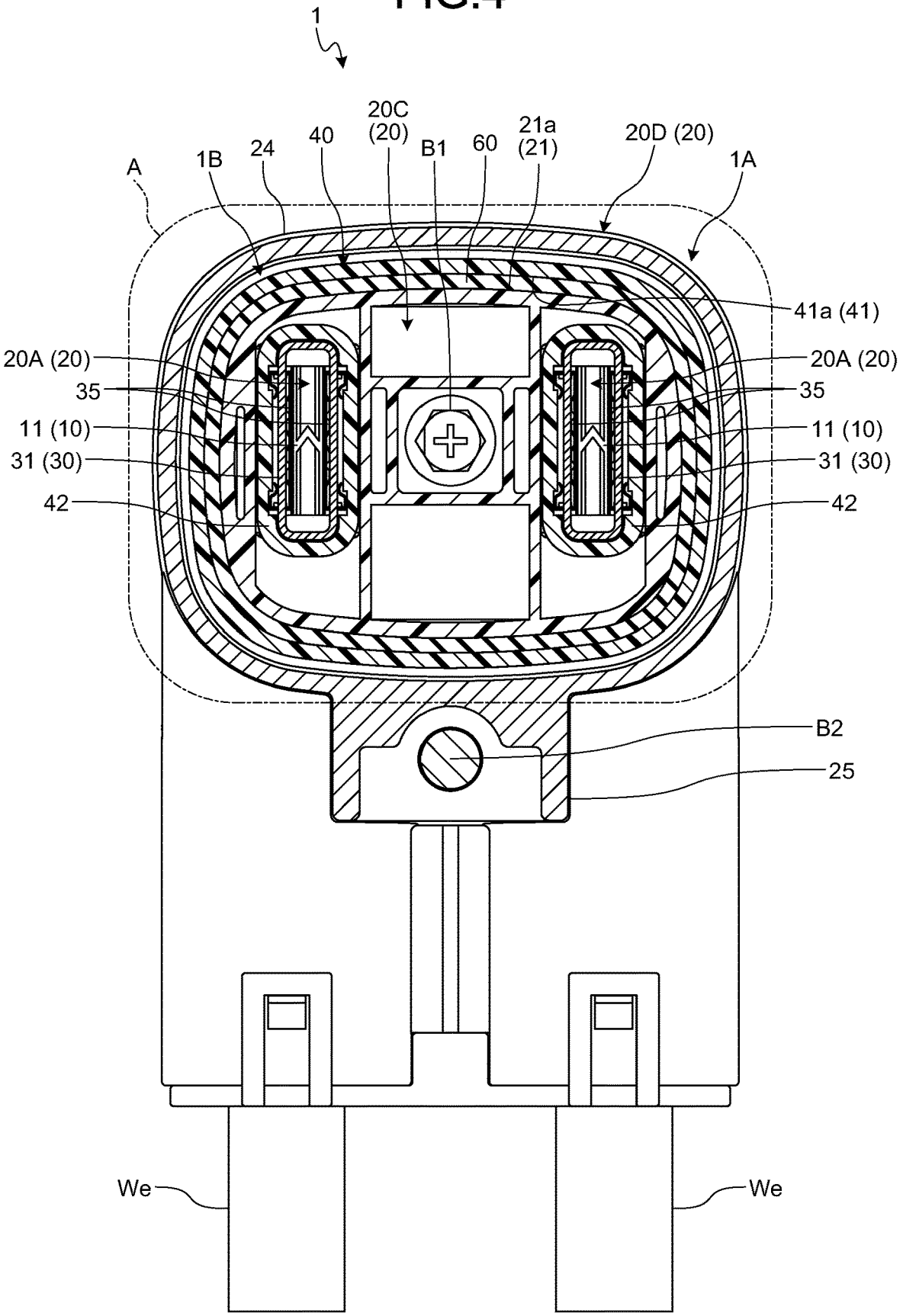
FIG. 4 is a cross-sectional view taken along line X-X of FIG. 3.
Figure 6:
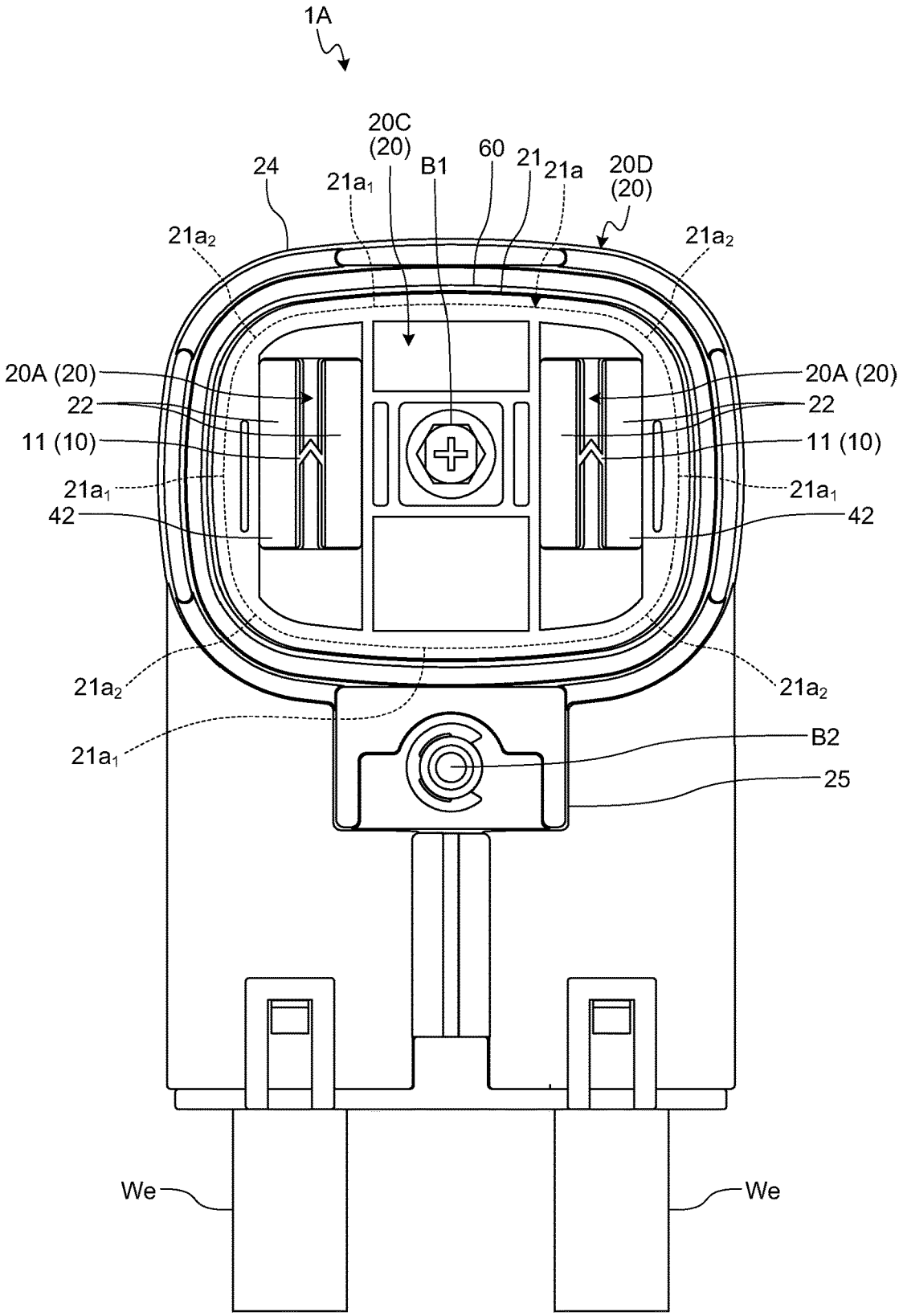
FIG. 6 is a plan view of a first connector of the embodiment as viewed in a connector insertion/removal direction.

The first connector 1A includes a terminal fitting 10 and a housing component 20 which houses the terminal fitting 10 (FIGS. 4 and 6). Further, the second connector 1B includes a mating terminal fitting 30 and a mating housing component 40 which houses the mating terminal fitting 30 (FIGS. 1 to 4). The first connector 1A includes a plurality of terminal fittings 10, and an electric wire We (FIGS. 1 to 3) electrically connected to each of the terminal fittings 10 is drawn out to the outside. Further, the second connector 1B includes the same number of mating terminal fittings 30 as the terminal fittings 10. In the embodiment, the second connector includes two terminal fittings 10 and two mating terminal fittings 30.

Figure 2:
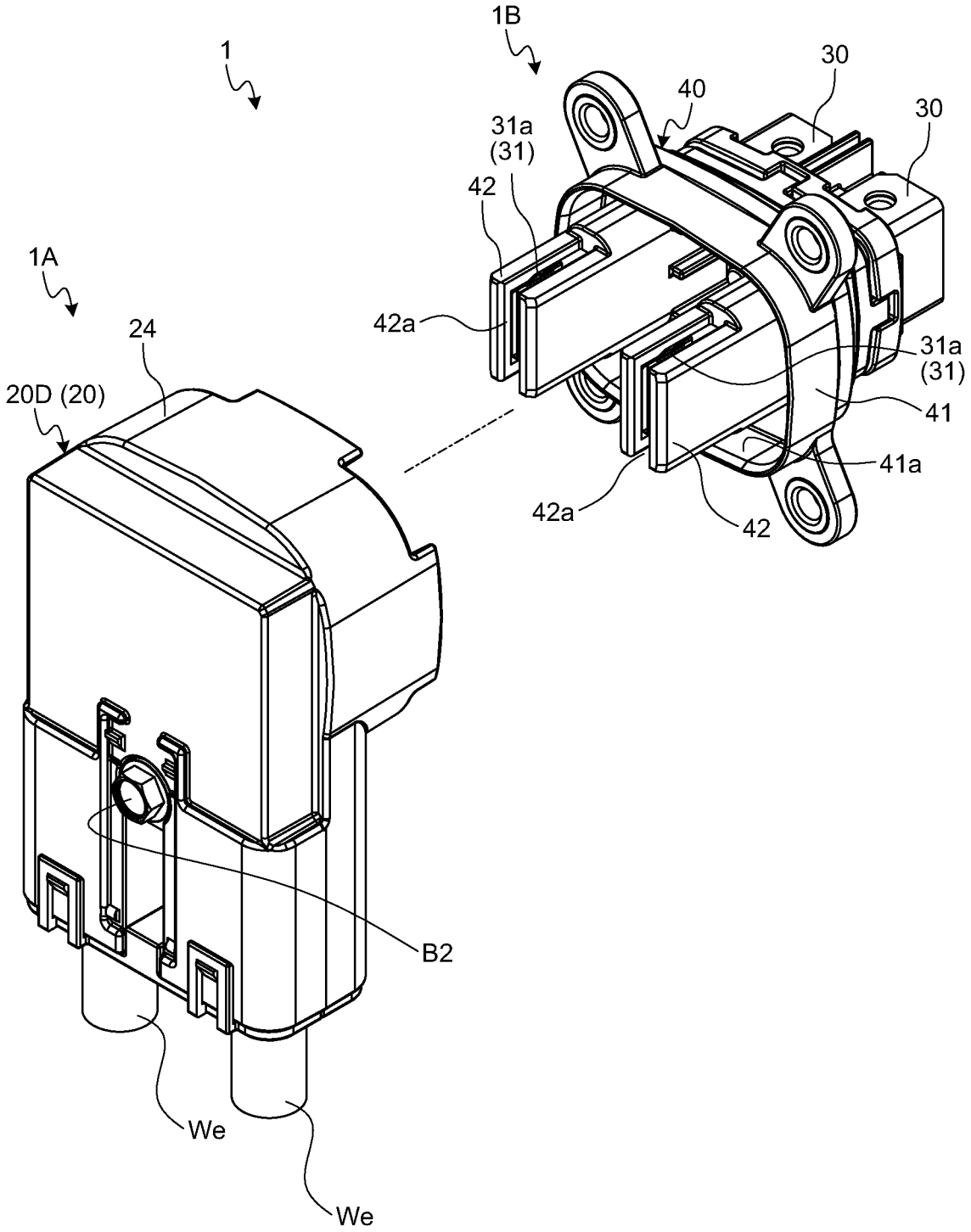
FIG. 2 is a perspective view illustrating a state before fitting and connecting the fitting connector of the embodiment as viewed from a different angle.
Figure 3:
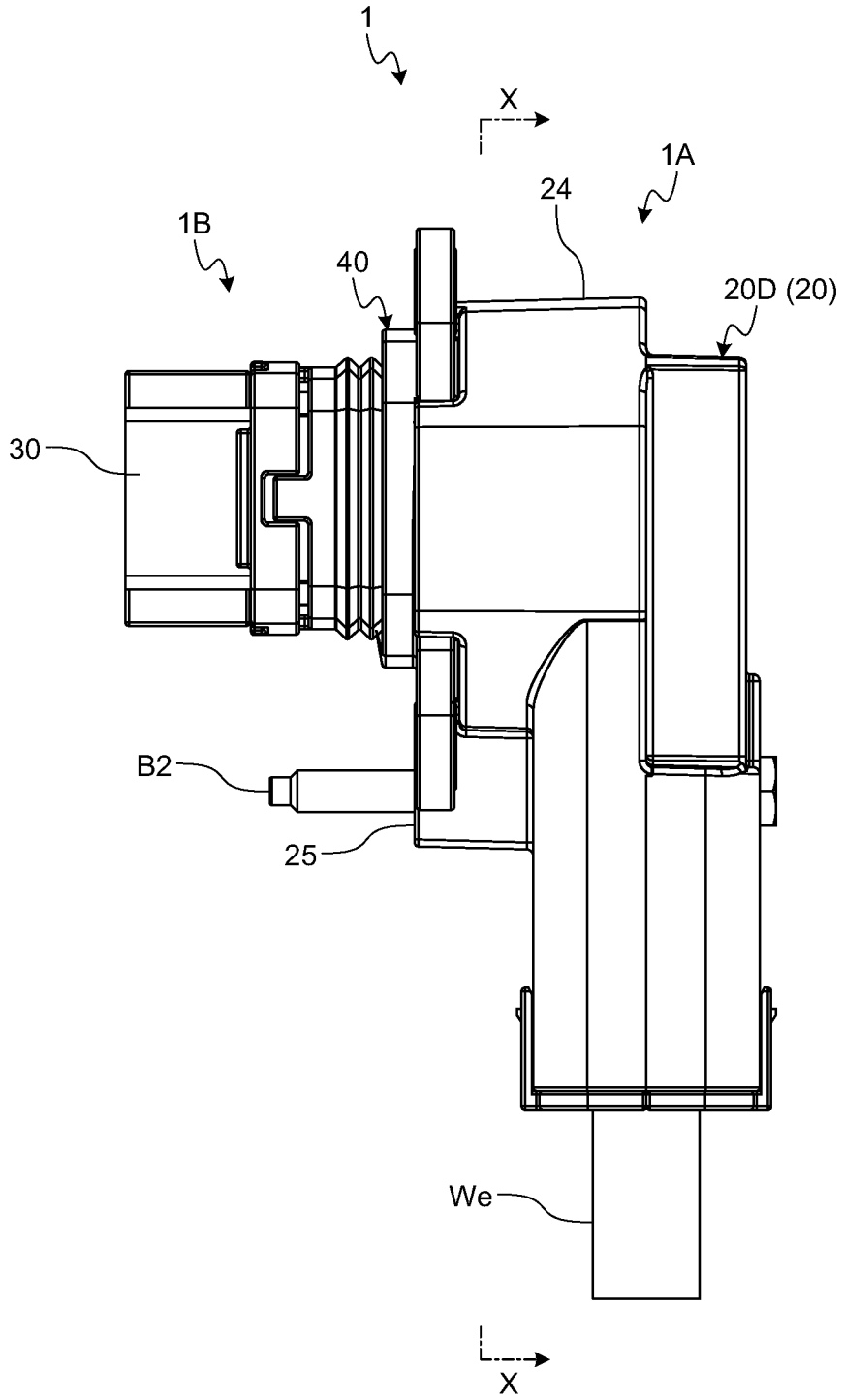
FIG. 3 is a plan view illustrating a state after fitting and connecting the fitting connector of the embodiment.
Figure 8:
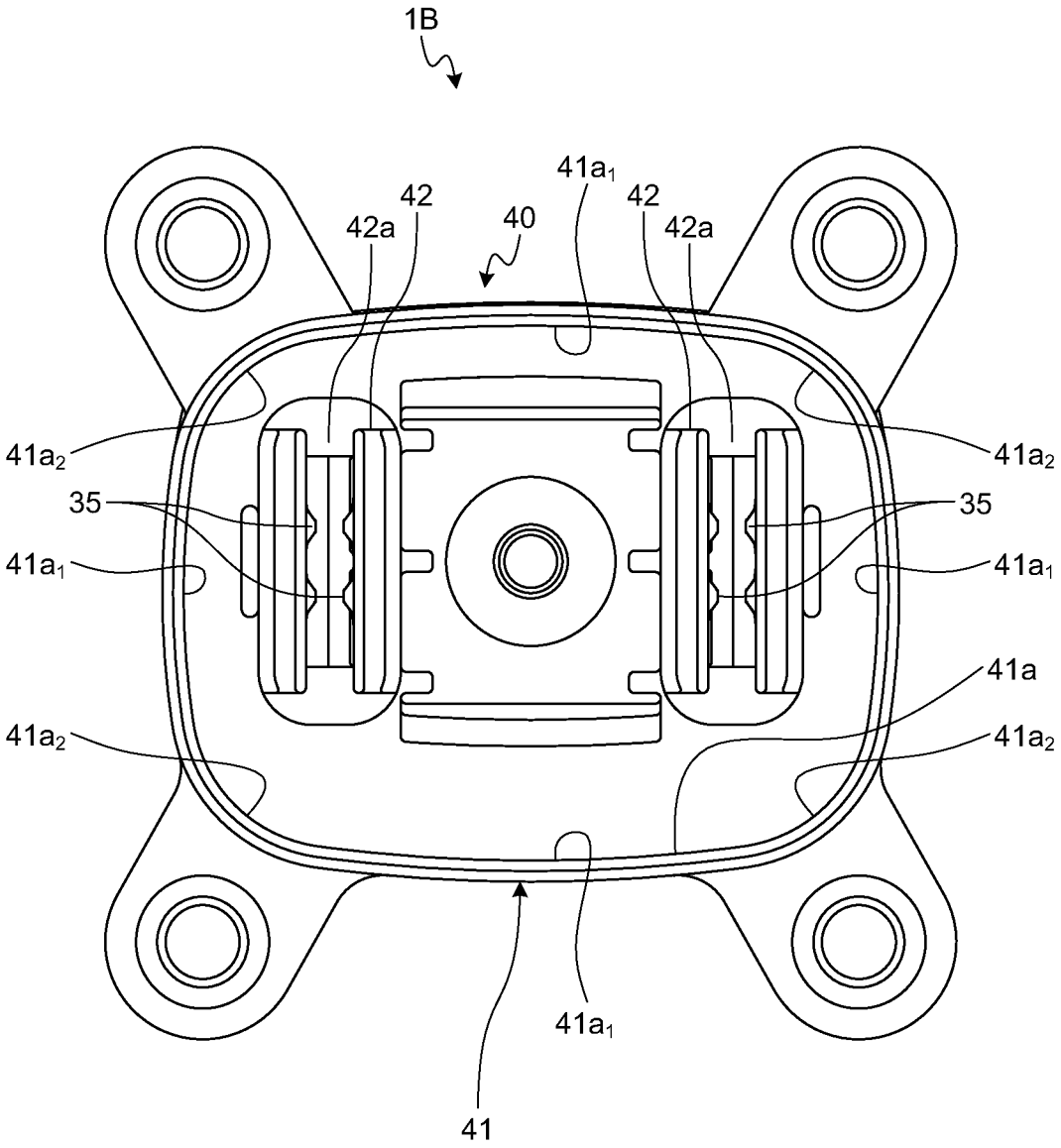
FIG. 8 is a plan view of a second connector of the embodiment as viewed in the connector insertion/removal direction.

Each of the terminal fitting 10 and the mating terminal fitting 30 is molded of a conductive material such as a metal material. The terminal fitting 10 and the mating terminal fitting 30 have terminal connecting portions 11 and 31 which are physically and electrically connected to each other at the fitting completion position (FIG. 4). The illustrated terminal connecting portions 11 and 31 are each electrically connected by being fitted to each other at the fitting completion position. One of the terminal connecting portions 11 and 31 is formed in a female terminal shape, and the other of them is formed in a male terminal shape. The illustrated terminal connecting portion 11 is formed in a rectangular planar male terminal shape. Further, the illustrated terminal connecting portion 31 has two planar terminal portions 31*a* arranged with a spacing to face each other, where each of the terminal portions is formed in a female terminal shape in which the two terminal portions 31*a* sandwich the terminal connecting portion 11 from each of plane sides (FIGS. 1 and 2). Note that the terminal portion 31*a* is assembled with a spring contact member 35, and is electrically connected to the terminal connecting portion 11 via the spring contact member 35 for each of the terminal portion 31*a* (FIGS. 4 and 8).

Figure 5:
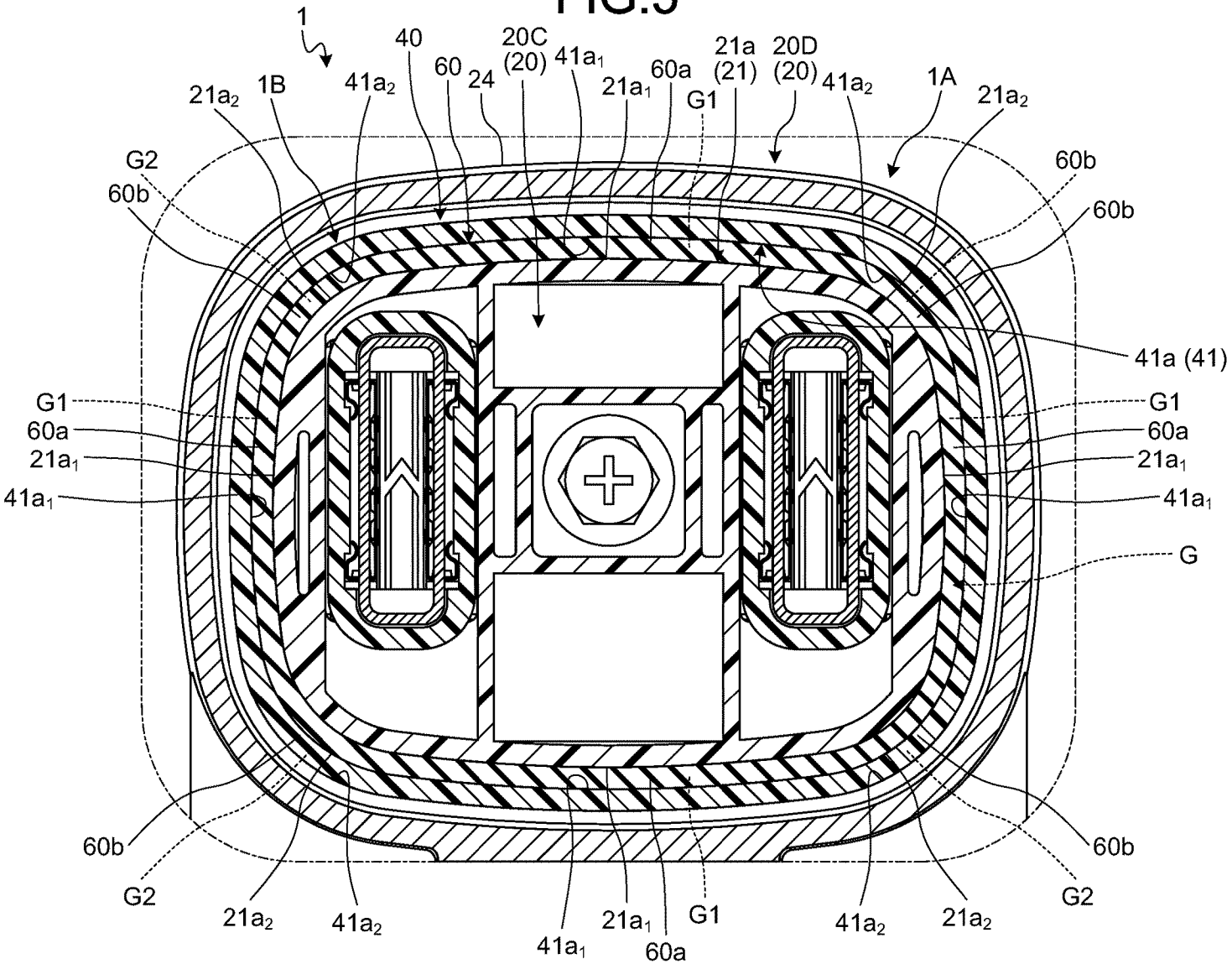
FIG. 5 is an enlarged view of a portion A in FIG. 4.

The housing component 20 is provided with a fitting portion 21 (FIGS. 1 and 4 to 7). The mating housing component 40 is provided with a mating fitting portion 41 (FIGS. 1, 2, 4, 5 and 8). The fitting portion 21 and the mating fitting portion 41 are inserted and fitted to each other along a connector insertion direction to the fitting completion position, and are separated from each other along a connector removal direction opposite to the connector insertion direction. The housing component 20 and the mating housing component 40 illustrated here insert and fit the fitting portion 21 into the mating fitting portion 41. Therefore, in the housing component 20 and the mating housing component 40, the outer peripheral surface 21*a* of the fitting portion 21 is fitted and connected to the inner peripheral surface 41*a* of the mating fitting portion 41, and an annular gap G is formed between the outer peripheral surface 21*a* and the inner peripheral surface 41*a* at the fitting completion position (FIG. 5).

Figure 7:
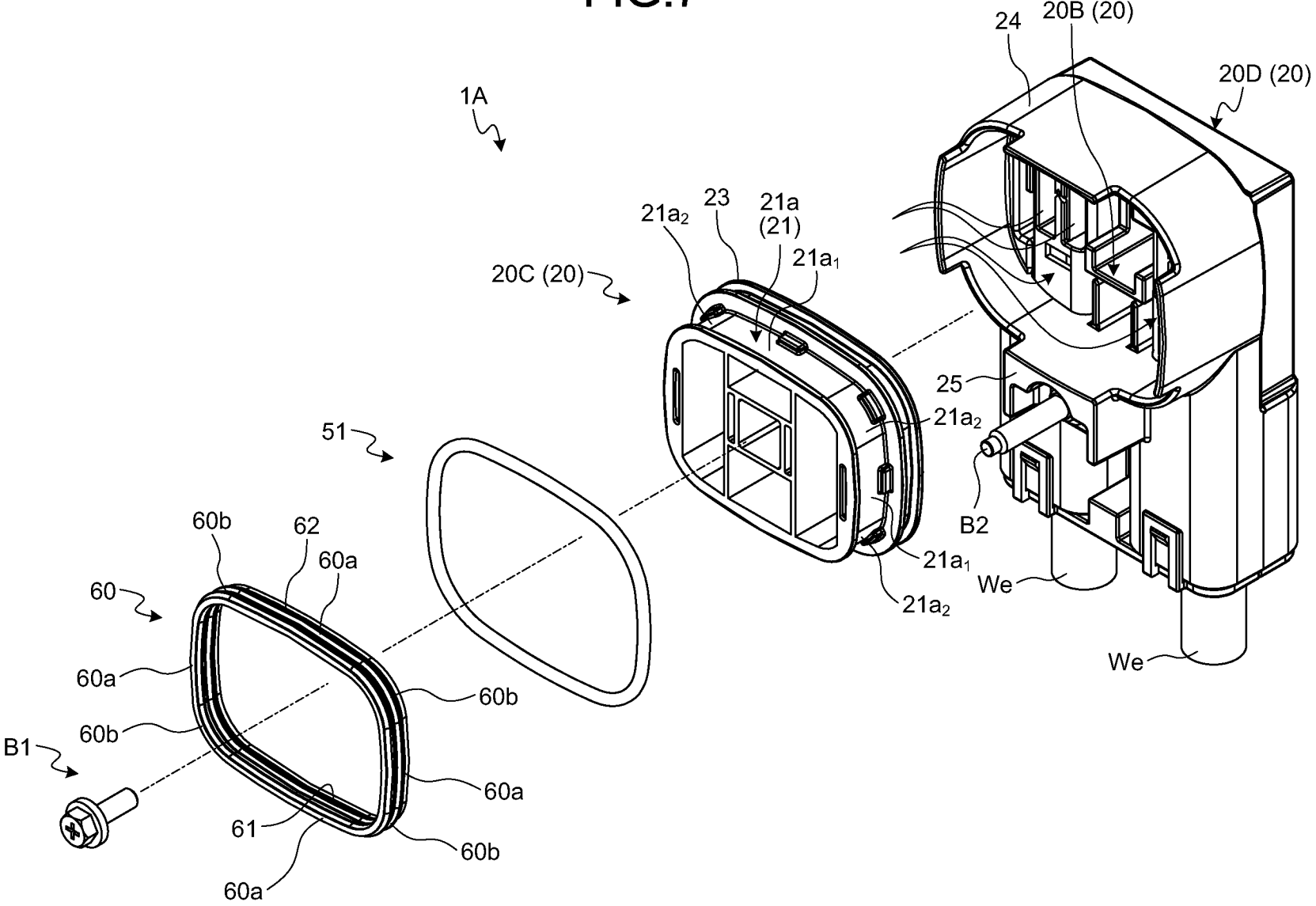
FIG. 7 is an exploded perspective view of the first connector of the embodiment partially disassembled.

The housing component 20 illustrated here includes a plurality of divided housings (a first housing 20A, a second housing 20B, and a third housing 20C) and a shield shell 20D (FIG. 7). The housing component 20 is such that the first housing 20A, the second housing 20B and the third housing 20C are molded of an insulating material such as synthetic resin, and the shield shell 20D is molded of a metal material.

The first housing 20A is a housing member for housing the terminal fitting 10 and for drawing out the electric wire We physically and electrically connected to the terminal fitting 10 to the outside. The first housing 20A is provided for each terminal fitting 10. The first housing 20A has the electric wire We drawn out in a direction perpendicular to the connector insertion/removal direction (connector insertion direction and connector removal direction). Further, the first housing 20A has two insertion ports 22 with openings in the connector insertion direction, where the terminal connecting portions 31 of the mating terminal fittings 30 inserted through the two insertion ports 22 are connected to respective planes of the terminal connecting portions 11 (FIGS. 6 and 7). The second housing 20B is a housing member for holding the two first housings 20A to arrange the two first housings 20A (i.e., two terminal fittings 10) in a predetermined positional relationship.

The third housing 20C is a housing member formed with the fitting portion 21. The third housing 20C is formed in a cylindrical shape, and arranged in front of the insertion ports 22 of the two first housings 20A in such a manner that the cylindrical axial direction of the third housing is aligned with the connector insertion/removal direction. The mating terminal fitting 30 reaches the insertion port 22 of the first housing 20A through the inner space of the third housing 20C. The third housing 20C also has a coaxial annular flange portion 23 formed to project from the outer peripheral surface 21*a* of the cylindrical fitting portion 21 (FIG. 7). The flange portion 23 is provided to obtain waterproof performance between the shield shell 20D described below and the flange portion.

The shield shell 20D is a noise shield member for suppressing intrusion of noise from the outside into the terminal fitting 10 and the electric wire We. Therefore, the shield shell 20D has the first housing 20A, the second housing 20B, and the third housing 20C housed inside. The shield shell 20D has a cylindrical portion 24 formed in a cylindrical shape, in which the cylindrical portion 24 has the third housing 20C coaxially disposed inside (FIGS. 1 and 4 to 7). The second housing 20B and the third housing 20C are screwed and fixed to the shield shell 20D by a screw member B1 inserted from the opening of the cylindrical portion 24 (FIGS. 4, 6 and 7).

The housing component 20 is provided with an annular water cut-off member 51 for sealing an annular gap between the inner peripheral surface of the cylindrical portion 24 and the outer peripheral surface of the flange portion 23 of the third housing 20C (FIG. 7). The water cut-off member 51 is a so-called packing molded of an elastic material such as rubber, and is assembled to the third housing 20C with its inner peripheral side brought into close contact with the outer peripheral surface of the flange portion 23.

The mating housing component 40 illustrated here is a housing molded of an insulating material such as synthetic resin and formed with a mating fitting portion 41. The mating fitting portion 41 is formed in a cylindrical shape.

Further, the mating housing component 40 is formed with a terminal housing portion 42 projecting in the cylindrical axial direction from the inside of the mating fitting portion 41 (FIGS. 1, 2, 4 and 8). The terminal housing portion 42 is provided for each mating terminal fitting 30 and houses the terminal connecting portion 31 of the mating terminal fitting 30 and the spring contact member 35. In other words, the terminal housing portion 42 houses two pairs of the terminal portions 31*a* and the spring contact members 35. Therefore, the terminal housing portion 42 has a cutout 42*a* formed so as to insert the terminal connecting portion 11 between the two pairs (FIGS. 1, 2 and 8).

Figure 9:
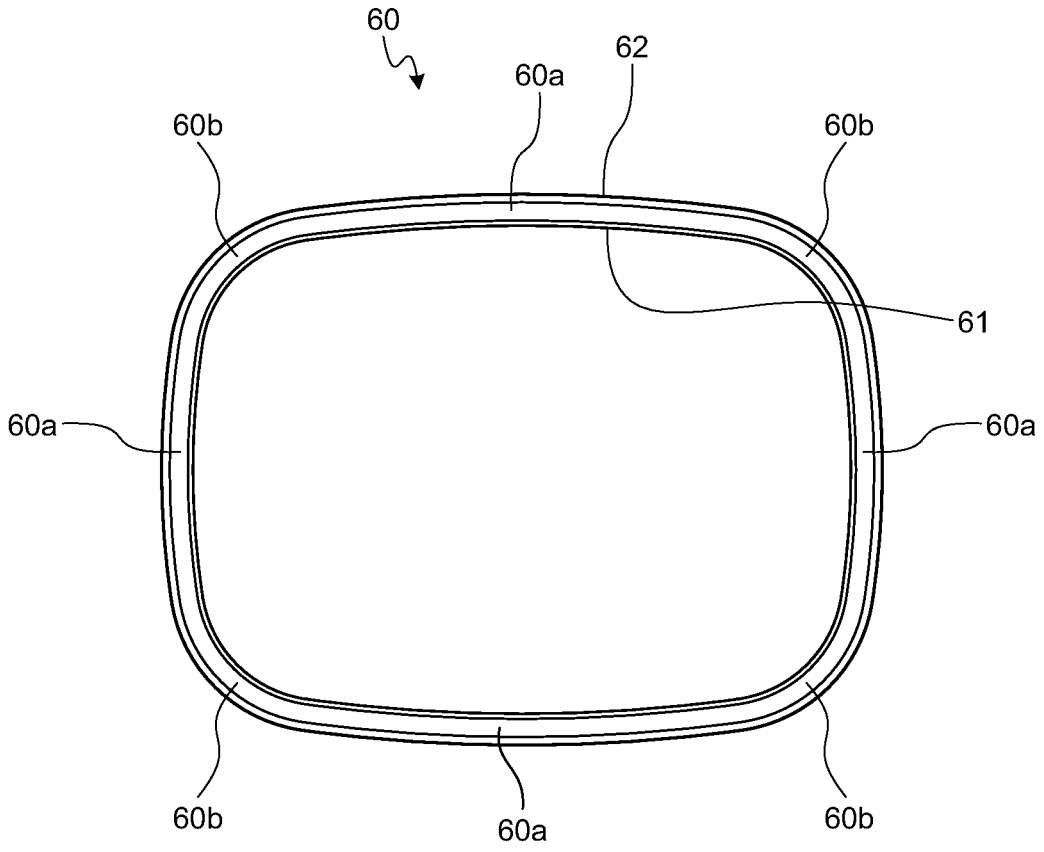
FIG. 9 is a plan view illustrating a water cut-off member.

As described above, the annular gap G is formed between the fitting portion 21 and the mating fitting portion 41 at the fitting completion position. The housing component 20 is provided with the annular water cut-off member 60 for sealing the annular gap G (FIGS. 1, 4 to 7 and 9). The water cut-off member 60 is a so-called packing molded of an elastic material such as rubber, and at the fitting completion position, brings its inner peripheral side into close contact with the outer peripheral surface 21*a* of the fitting portion 21, and brings its outer peripheral side into close contact with the inner peripheral surface 41*a* of the mating fitting portion 41. The water cut-off member 60 illustrated here has a plurality of annular lips (inner peripheral lip) 61 formed on the inner peripheral side, and a plurality of annular lips (outer peripheral lip) 62 formed on the outer peripheral side (FIGS. 7 and 9).

The water cut-off member 60 is assembled to the outer peripheral surface 21*a* of the fitting portion 21 or the inner peripheral surface 41*a* of the mating fitting portion 41. The water cut-off member 60 illustrated here is assembled to the outer peripheral surface 21*a* of the fitting portion 21 with its inner peripheral side brought into close contact with the outer peripheral surface (FIGS. 1 and 4 to 7).

The first connector 1A has the fitting portion 21 formed in a cylindrical shape having an outer peripheral surface 21*a* in which a plurality of side portions (hereinafter referred to as "outer peripheral side portion") $\mathbf{21}a_1$ and a plurality of corner portions (hereinafter referred to as "outer peripheral corner portion") $\mathbf{21}a_2$ are alternately connected in a circumferential direction (FIG. 5). The second connector 1B has the mating fitting portion 41 formed in a cylindrical shape having an inner peripheral surface 41*a* in which a plurality of side portions (hereinafter referred to as "inner peripheral side portion") $\mathbf{41}a_1$ for each outer peripheral side portion $\mathbf{21}a_1$ arranged with a first gap G1 to face the outer peripheral side portion $\mathbf{21}a_1$ at the fitting completion position and a plurality of corner portions (hereinafter referred to as "inner peripheral corner portion") $\mathbf{41}a_2$ for each outer peripheral corner portion $\mathbf{21}a_2$ arranged with a second gap G2 to face the outer peripheral corner portion $\mathbf{21}a_2$ at the fitting completion position are alternately connected in the circumferential direction (FIG. 5). In other words, the annular gap G between the fitting portion 21 and the mating fitting portion 41 is formed in such a shape that a plurality of the first gaps G1 formed by a pair of the outer peripheral side portions $\mathbf{21}a_1$ and the inner peripheral side portions $\mathbf{41}a_1$ and a plurality of the second gaps G2 formed by a pair of the outer peripheral corner portions $\mathbf{21}a_2$ and the inner peripheral corner portions $\mathbf{41}a_2$ are alternately connected in the circumferential direction.

The water cut-off member 60 disposed in the annular gap G is formed into a shape corresponding to the shape of the gap G. In other words, the water cut-off member 60 is formed in an annular shape having a side portion (hereinafter referred to as "water cut-off side portion") 60*a* for each combination of the pair of the outer peripheral side portions $\mathbf{21}a_1$ and the inner peripheral side portions $\mathbf{41}a_1$ that brings the inner peripheral side and the outer peripheral side into close contact between the pair of the outer peripheral side portions $\mathbf{21}a_1$ and the inner peripheral side portions $\mathbf{41}a_1$, and a corner portion (hereinafter referred to as "water cut-off corner portion") 60*b* for each combination of the pair of the outer peripheral corner portions $\mathbf{21}a_2$ and the inner peripheral corner portions $\mathbf{41}a_2$ that brings the inner peripheral side and the outer peripheral side into close contact between the pair of the outer peripheral corner portions 21$a_2$ and the inner peripheral corner portions 41$a_2$ (FIGS. 5 and 9).

Note that the outer peripheral surface 21*a* of the fitting portion 21 comprises three or more outer peripheral side portions 21$a_1$ and three or more outer peripheral corner portions 21$a_2$. Therefore, the inner peripheral surface 41*a* of the mating fitting portion 41 comprises three or more inner peripheral side portions 41$a_1$ and three or more inner peripheral corner portions 41$a_2$. The water cut-off member 60 comprises three or more water cut-off side portions 60*a* and three or more water cut-off corner portions 60*b*. Therefore, the annular gap G has three or more first gaps G1 and three or more second gaps G2.

The outer peripheral surface 21*a* of the fitting portion 21 illustrated here comprises four outer peripheral side portions 21$a_1$ and four outer peripheral corner portions 21$a_2$ (FIG. 5). Therefore, the inner peripheral surface 41*a* of the mating fitting portion 41 illustrated here comprises four inner peripheral side portions 41$a_1$ and four inner peripheral corner portions 41$a_2$. The water cut-off member 60 illustrated here comprises four water cut-off side portions 60*a* and four water cut-off corner portions 60*b* (FIGS. 5 and 9). Therefore, the annular gap G illustrated here has four first gaps G1 and four second gaps G2 (FIG. 5). In other words, the fitting connector 1 illustrate here has the fitting portion 21 and the mating fitting portion 41 each formed in a square cylindrical shape, and the water cut-off member 60 formed into a square annular shape in accordance with the square cylindrical shape.

Figure 10:
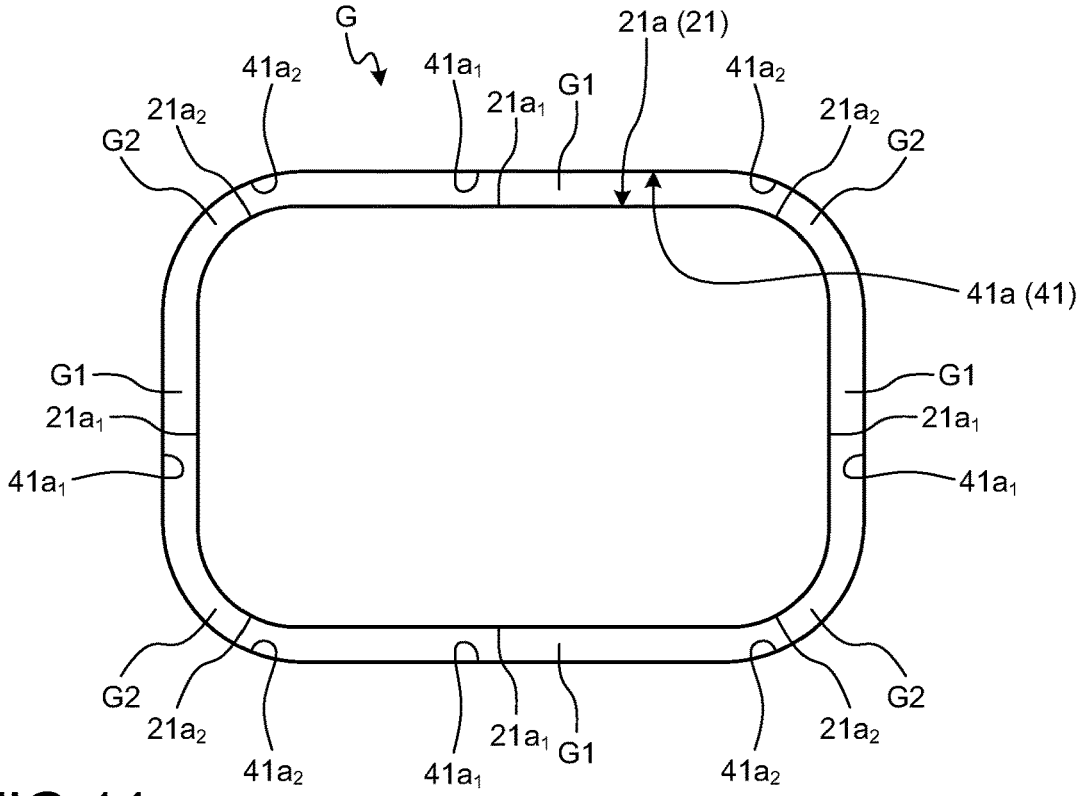
FIG. 10 is an explanatory diagram illustrating a variation of an annular gap.
Figure 11:
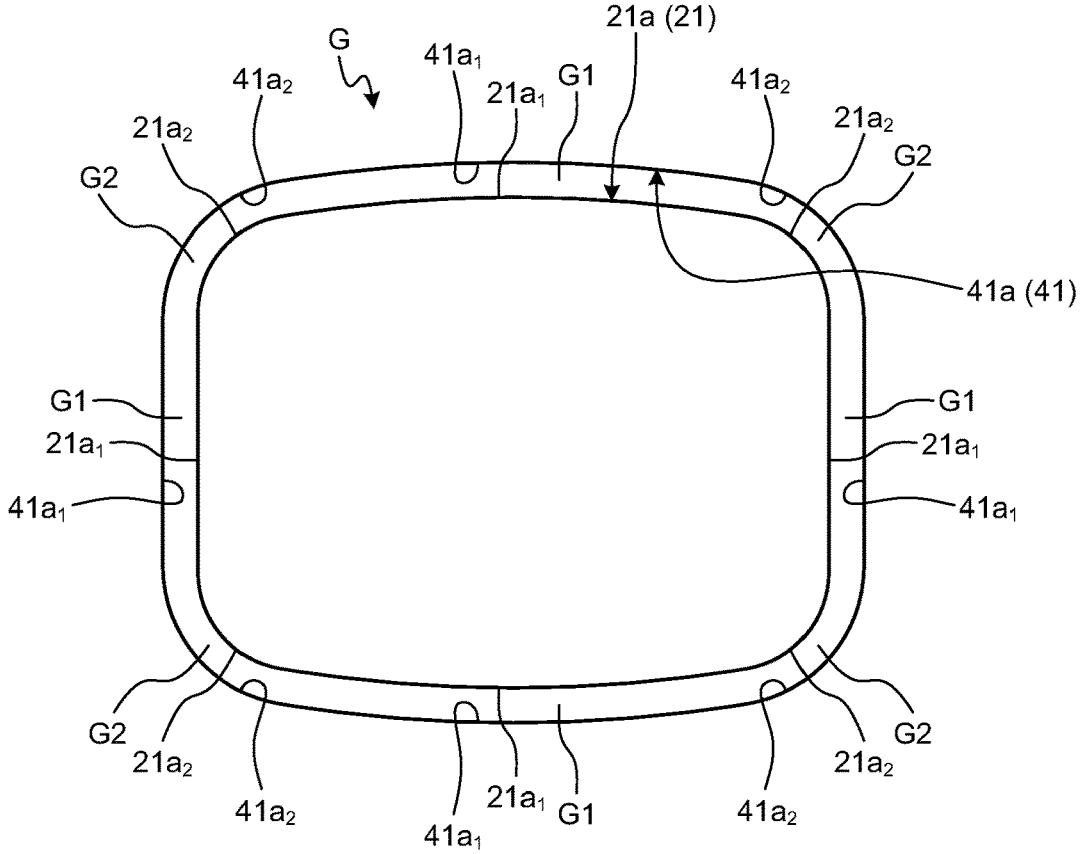
FIG. 11 is an explanatory diagram illustrating a variation of the annular gap.
Figure 12:
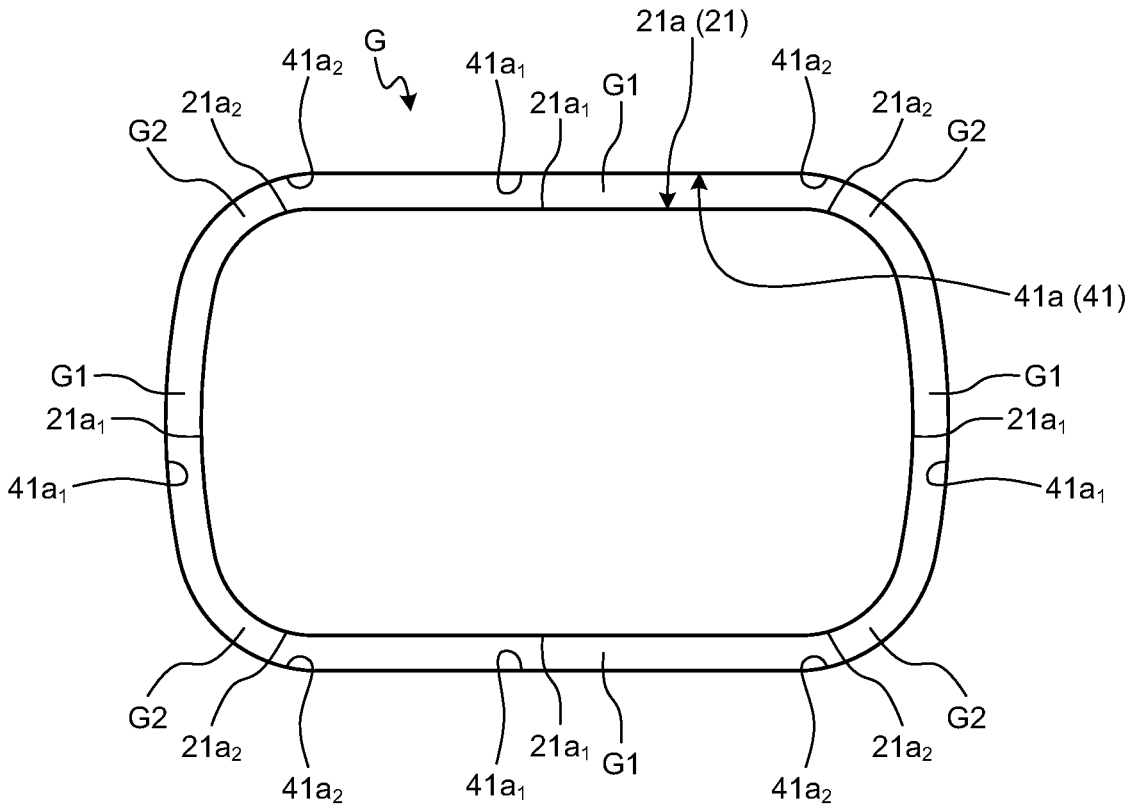
FIG. 12 is an explanatory diagram illustrating a variation of the annular gap.

A plurality of the first gaps G1 is formed such that all of the first gaps are arcuate or linear, or is formed such that arcuate and linear shapes are mixed. A plurality of the second gaps G2 is formed such that all of the second gaps are arcuate. In other words, all combinations of the pair of the outer peripheral side portions 21$a_1$ and the inner peripheral side portions 41$a_1$ are formed to be convexly arcuate in the same direction for each of the combinations, or to be linear for all of the combinations. Further, all combinations of the pair of the outer peripheral side portions 21$a_1$ and the inner peripheral side portions 41$a_1$ may be formed to mix such arcuate combinations with linear combinations. All combinations of the pair of the outer peripheral corner portions 21$a_2$ and the inner peripheral corner portions 41$a_2$ are formed to be convexly arcuate in the same direction for each of the combinations. The annular gap G illustrated here is formed such that all of the first gaps G1 and all of the second gaps G2 are convexly arcuate on the inner peripheral surface 41*a* side of the mating fitting portion 41. Note that FIG. 10 illustrates, as an example, an annular gap G formed such that all of the first gaps G1 are linear and all of the second gaps G2 are convexly arcuate on the inner peripheral surface 41*a* side of the mating fitting portion 41. Further, FIG. 11 illustrates, as an example, an annular gap G formed such that two of the first gaps G1 on the longer side are convexly arcuate on the inner peripheral surface 41*a* side of the mating fitting portion 41, two of the first gaps G1 on the shorter side are linear, and all of the second gaps G2 are convexly arcuate on the inner peripheral surface 41*a* of the mating fitting portion 41. Further, FIG. 12 illustrates, as an example, an annular gap G formed such that two of the first gaps G1 on the longer side are linear, two of the first gaps G1 on the shorter side are convexly arcuate on the inner peripheral surface 41*a* side of the mating fitting portion 41, and all of the second gaps G2 are convexly arcuate on the inner peripheral surface 41*a* side of the mating fitting portion 41.

As described above, the fitting connector 1 has the annular gap G having the second gap G2 serving as a corner portion at a plurality of positions, and therefore, the water cut-off member 60 is formed with a water cut-off corner portion 60*b* for each of the second gaps G2. Therefore, in the water cut-off member 60 applied to the fitting connector 1, the water cut-off corner portion 60*b* may possibly be less likely to be elastically deformed than the water cut-off side portion 60*a*. Therefore, the fitting connector 1 is such that at least one of the outer peripheral corner portion 21$a_2$ and the inner peripheral corner portion 41$a_2$ is formed so that the spacing of the second gap G2 is narrower than the spacing of the first gap G1, in order to increase the adhesion of the water cut-off corner portion 60*b* to the outer peripheral corner portion 21$a_2$ of the fitting portion 21 and the inner peripheral corner portion 41$a_2$ of the mating fitting portion 41 in the second gap G2, thereby forming an annular gap G comprising the first gap G1 and the second gap G2. The spacing of the second gap G2 is applied to all of the second gaps G2. Thus, the fitting connector 1 is such that the crushing margin of the water cut-off corner portion 60*b* sandwiched and crushed between the outer peripheral corner portion 21$a_2$ and the inner peripheral corner portion 41$a_2$ is larger than that of the water cut-off side portion 60*a* sandwiched and crushed between the outer peripheral side portion 21$a_1$ and the inner peripheral side portion 41$a_1$, and thus can increase the adhesion of the water cut-off corner portion 60*b* to the outer peripheral corner portion 21$a_2$ and the inner peripheral corner portion 41$a_2$. Thus, the fitting connector 1 and the first connector 1A of the present embodiment can improve the sealing performance between the fitting portion 21 and the mating fitting portion 41.

Specifically, at least one of the outer peripheral corner portion 21$a_2$ and the inner peripheral corner portion 41$a_2$ is formed so that the spacing of the second gap G2 is narrower than the spacing of the first gap G1. For example, the fitting portion 21 is formed to have an outer peripheral surface 21*a* having the outer peripheral corner portion 21$a_2$ closer to the inner peripheral corner portion 41$a_2$ side, as compared with the conventional fitting portion in which the spacing of the first gap G1 and the spacing of the second gap G2 are uniform. Thus, the fitting connector 1 can improve the sealing performance of the first connector 1A between the fitting portion 21 and the mating fitting portion 41. Further, the mating fitting portion 41 may be formed to have an inner peripheral surface 41*a* having the inner peripheral corner portion 41$a_2$ closer to the outer peripheral corner portion 21$a_2$ side as compared with the conventional mating fitting portion. Thus, the fitting connector 1 can improve the sealing performance of the second connector 1B between the fitting portion 21 and the mating fitting portion 41. In this example, the outer peripheral corner portion 21$a_2$ is formed closer to the inner peripheral corner portion 41$a_2$ side so that the spacing of the second gap G2 is narrower than the spacing of the first gap G1. In other words, in this example, the radius of curvature of the outer peripheral corner portion 21$a_2$ of the fitting portion 21 in the first connector 1A is reduced so that the spacing of the second gap G2 is narrower than the spacing of the first gap G1.

When the fitting portion 21 and the mating fitting portion 41 are at the fitting completion position, the first connector 1A illustrated here is screwed and fixed to the mating connector. For example, when the second connector 1B is attached to a casing (not illustrated) of an electric device such as an inverter, the casing is provided with a mating fixing portion (not illustrated) for fixing the first connector 1A. In the first connector 1A, the housing component 20 is provided with a fixing portion 25 for fixing to the mating fixing portion (FIGS. 1, 3, 4, 6 and 7). The first connector 1A includes a screw member B2 for screwing and fixing the fixing portion 25 of the housing component 20 to the mating fixing portion at the fitting completion position. In this example, since the fixing portion 25 is provided outside the cylindrical portion 24 in the shield shell 20D, and the screw member B2 is rotatably attached to the fixing portion 25 about its axis, the first connector 1A at fitting completion position is fixed to the casing by screwing the screw member B2 to the female screw portion of the mating fixing portion.

When such screwing and fixing is performed, the fitting connector 1 is such that rotational torque about the axis of the screw member B2 acts on the first connector 1A. Therefore, a relative force acts between the outer peripheral surface 21*a* of the fitting portion 21 and the inner peripheral surface 41*a* of the mating fitting portion 41, such as changing the spacing of the gap G by the rotational torque. However, since the water cut-off corner portion 60*b* of the water cut-off member 60 has a larger crushing margin in all of the second gaps G2, the fitting connector 1 and the first connector 1A of the present embodiment are such that each of the water cut-off corner portions 60*b* is less likely to be crushed any more than the crushing margin, and the relative displacement between the outer peripheral surface 21*a* of the fitting portion 21 and the inner peripheral surface 41*a* of the mating fitting portion 41 is suppressed, as compared with the conventional connectors. Thus, the fitting connector 1 and the first connector 1A can suppress the relative displacement between the outer peripheral surface 21*a* of the fitting portion 21 and the inner peripheral surface 41*a* of the mating fitting portion 41 even when a rotational torque about the axis is applied to the screw member B2, and thus suppress the change in the spacing of the gap G therebetween. Therefore, the fitting connector 1 and the first connector 1A can prevent the water cut-off member 60 from being unevenly deformed, and thus suppress deterioration in sealing performance after screwing and fixing.

The connector according to the present embodiment is such that a fitting portion is formed to have an outer peripheral surface having an outer peripheral corner portion closer to an inner peripheral corner portion side, as compared with the conventional fitting portion in which a spacing of a first gap and a spacing of a second gap are uniform. Further, the fitting connector according to the present embodiment is such that at least one of the outer peripheral corner portion and the inner peripheral corner portion is formed so that the spacing of the second gap is narrower than the spacing of the first gap, thereby forming an annular gap comprising the first gap and the second gap. Therefore, the connector and the fitting connector are such that the crushing margin of the water cut-off corner portion sandwiched and crushed between the outer peripheral corner portion and the inner peripheral corner portion is larger than the crushing margin of the water cut-off side portion sandwiched and crushed between the outer peripheral side portion and the inner peripheral side portion, and thus can increase the adhesion of the water cut-off corner portion to the outer peripheral corner portion and the inner peripheral corner portion. Thus, the connector and the fitting connector according to the present embodiment can improve the sealing performance between the fitting portion and the mating fitting portion.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

a terminal fitting;

a housing component which houses the terminal fitting and is provided with a fitting portion for fitting and connecting an outer peripheral surface of the fitting portion to an inner peripheral surface of a mating fitting portion; and an annular water cut-off member which is assembled to the outer peripheral surface of the fitting portion with an inner peripheral side of the water cut-off member brought into close contact with the outer peripheral surface, and brings an outer peripheral side of the water cut-off member into close contact with the inner peripheral surface of the mating fitting portion at a fitting completion position of the fitting portion and the mating fitting portion, wherein the fitting portion has the outer peripheral surface in which a plurality of outer peripheral side portions for each of the inner peripheral side portion arranged with a first gap to face the inner peripheral side portion of the inner peripheral surface of the mating fitting portion at the fitting completion position, and a plurality of outer peripheral corner portions for each of the inner peripheral corner portion arranged with a second gap to face the inner peripheral corner portion of the inner peripheral surface of the mating fitting portion at the fitting completion position, are alternately connected in a circumferential direction, the water cut-off member has a water cut-off side portion for each combination of a pair of the outer peripheral side portions and the inner peripheral side portions that brings the inner peripheral side and the outer peripheral side into close contact between the pair of the outer peripheral side portions and the inner peripheral side portions, and a water cut-off corner portion for each combination of a pair of the outer peripheral corner portions and the inner peripheral corner portions that brings the inner peripheral side and the outer peripheral side into close contact between the pair of the outer peripheral corner portions and the inner peripheral corner portions, the outer peripheral corner portion is formed so that a spacing of the second gap is narrower than a spacing of the first gap, a plurality of the first gaps is formed such that all of the first gaps are arcuate, and a plurality of the second gaps is formed such that all of the second gaps are arcuate.

2. The connector according to claim 1, wherein the outer peripheral surface of the fitting portion comprises the four outer peripheral side portions and the four outer peripheral corner portions.

3. The connector according to claim 1, further comprising:

a screw member for screwing and fixing a fixing portion of the housing component to a mating fixing portion at the fitting completion position.

4. The connector according to claim 2, further comprising:

a screw member for screwing and fixing a fixing portion of the housing component to a mating fixing portion at the fitting completion position.

5. A fitting connector comprising:

a first connector and a second connector electrically connected at a fitting completion position fitted to each other; and an annular water cut-off member provided on either one of the first connector and the second connector between the first connector and the second connector, wherein the first connector comprises a terminal fitting and a housing component which houses the terminal fitting and is provided with a fitting portion, the second connector includes a mating terminal fitting physically and electrically connected to the terminal fitting, and a mating housing component which houses the mating terminal fitting and is provided with a mating fitting portion for fitting and connecting an outer peripheral surface of the fitting portion to an inner peripheral surface of the mating fitting portion, the fitting portion has the outer peripheral surface in which a plurality of outer peripheral side portions and a plurality of outer peripheral corner portions are alternately connected in a circumferential direction, the mating fitting portion has the inner peripheral surface in which a plurality of inner peripheral side portions for each of the outer peripheral side portion arranged with a first gap to face the outer peripheral side portion at the fitting completion position of the mating fitting portion and the fitting portion, and a plurality of inner peripheral corner portions for each of the outer peripheral corner portion arranged with a second gap to face the outer peripheral corner portion at the fitting completion position, are alternately connected in a circumferential direction, the water cut-off member has a water cut-off side portion for each combination of a pair of the outer peripheral side portions and the inner peripheral side portions that brings an inner peripheral side and an outer peripheral side of the water cut-off member into close contact between the pair of the outer peripheral side portions and the inner peripheral side portions, and a water cut-off corner portion for each combination of a pair of the outer peripheral corner portions and the inner peripheral corner portions that brings the inner peripheral side and the outer peripheral side into close contact between the pair of the outer peripheral corner portions and the inner peripheral corner portions, and the water cut-off member is assembled to the outer peripheral surface of the fitting portion or the inner peripheral surface of the mating fitting portion, at least one of the outer peripheral corner portion and the inner peripheral corner portion is formed so that a spacing of the second gap is narrower than a spacing of the first gap, a plurality of the first gaps is formed such that all of the first gaps are arcuate, and a plurality of the second gaps is formed such that all of the second gaps are arcuate.

* * * * *